US006812199B2

(12) United States Patent
Dasque et al.

(10) Patent No.: US 6,812,199 B2
(45) Date of Patent: Nov. 2, 2004

(54) METHOD FOR TREATING STAINED MATERIALS

(75) Inventors: Bruno Matthieu Dasque, Newcastle-Upon-Tyne (GB); David William York, Newcastle-Upon-Tyne (GB); Nigel Patrick Sommerville-Roberts, Newcastle-Upon-Tyne (GB); Olivier Charles Raineau, Surrey (GB)

(73) Assignee: The Procter & Gamble Company, Cincinnati, OH (US)

( * ) Notice: Subject to any disclaimer, the term of this patent is extended or adjusted under 35 U.S.C. 154(b) by 68 days.

(21) Appl. No.: 10/279,242

(22) Filed: Oct. 24, 2002

(65) Prior Publication Data

US 2003/0092590 A1 May 15, 2003

Related U.S. Application Data

(63) Continuation of application No. PCT/US01/07713, filed on Mar. 9, 2001.

(30) Foreign Application Priority Data

| | | |
|---|---|---|
| Apr. 28, 2000 | (GB) | 0010220 |
| Apr. 28, 2000 | (GB) | 0010227 |
| Apr. 28, 2000 | (GB) | 0010229 |
| Apr. 28, 2000 | (GB) | 0010249 |
| Oct. 5, 2000 | (GB) | 0024364 |

(51) Int. Cl.[7] ..... C11D 17/04; D06L 1/00; B08B 9/20

(52) U.S. Cl. ..... 510/439; 510/296; 8/137; 134/25.2; 134/42

(58) Field of Search ..... 510/439, 296; 8/137; 134/25.2, 42

(56) References Cited

U.S. PATENT DOCUMENTS

| | | | | | |
|---|---|---|---|---|---|
| 4,356,099 | A | * | 10/1982 | Davies et al. | 510/297 |
| 4,846,992 | A | * | 7/1989 | Fonsny | 510/296 |
| 4,963,158 | A | | 10/1990 | Beaujean et al. | 8/137 |
| 4,973,416 | A | | 11/1990 | Kennedy | 510/296 |
| 5,132,036 | A | * | 7/1992 | Falou et al. | 510/277 |
| 5,389,284 | A | * | 2/1995 | van der Hoeven et al. | 510/413 |
| 6,037,319 | A | * | 3/2000 | Dickler et al. | 510/439 |
| 6,281,183 | B1 | * | 8/2001 | Harbour | 510/406 |
| 6,624,130 | B2 | * | 9/2003 | Giblin et al. | 510/297 |

FOREIGN PATENT DOCUMENTS

| | | | |
|---|---|---|---|
| DE | 41 13786 | A1 | 11/1991 |
| EP | 0132726 | * | 2/1985 |
| EP | 0 608 910 | A1 | 4/1992 |
| FR | 2 796 651 | A1 | 1/2001 |
| JP | 4147000 | | 5/1992 |
| JP | 7290567 | | 11/1995 |
| WO | WO 93/08091 | | 4/1993 |

* cited by examiner

*Primary Examiner*—Lorna M. Douyon
(74) *Attorney, Agent, or Firm*—Armina E. Matthews; Brahm J. Corstanje; Kim William Zerby

(57) ABSTRACT

The present invention relates to a method for treating material with a treatment composition in a water-soluble pouch, whereby firstly a part of the composition is applied to the material by partially opening the pouch to allow dispensing of part of the treatment composition, and subsequently the material and the remaining of the pouched composition are washed in water. Preferred is a method whereby the pouch has at least two compartments and one compartment, comprising a liquid composition, is opened and the liquid composition is rubbed onto the material or preferably fabric, where after the remaining of the pouch (including the still closed compartment and composition therein) are added to the wash water, for example a washing machine.

18 Claims, No Drawings

METHOD FOR TREATING STAINED MATERIALS

CROSS REFERENCE TO RELATED APPLICATIONS

This is a continuation of International Application PCT/US01/07713 with an international filing date of Mar. 9, 2001, published in English under PCT Article 21(2) which claims benefit of Great Britain Application No. 0010229.3, filed Apr. 28, 2000; Great Britain Application No. 0010227.7, filed Apr. 28, 2000; Great Britain Application No. 0010249.1, filed Apr. 28, 2000; and Great Britain Application No. 0010220.2, filed Apr. 28, 2000

FIELD OF THE INVENTION

This invention relates to method for treating material with a treatment composition in a water-soluble pouch, whereby firstly a part of the composition is applied to the material by partially opening the pouch to allow dispensing of part of the treatment composition, and subsequently the material and the remaining of the pouched composition are washed in water.

BACKGROUND OF THE INVENTION

Cleaning products and fabric care products can be found on the market in various forms, such as granular compositions, liquid compositions and tablets. Such liquid laundry compositions have been marketed to be used with a device to hold an amount of liquid, which can be used to firstly dispense small amount of the liquid directly onto stains, and then to be put in the washing machine with cloths. A known example is the so-called 'rollerball' container, which can be rolled over the stains, thereby dispensing product, and then added to the washing machine The inventors have now found a new, even more convenient method of delivering two-step treatment with one device, namely a method whereby a treatment composition, by the user to allow dispensing of a part of the composition onto the stained material (for example fabrics) where after the user can put the pre-treated material and the remaining of the water-soluble pouched composition in the wash water, for example in the drawer or drum of a laundry washing machine. The user can easily hold the pouched composition and rub it onto the stains. There is no need any longer to add the composition to a dispensing device such as a 'rollerball', nor to retrieve this from the wash after use.

The pouch or multitude of pouches herein comprises typically (in total) an amount sufficient for a cleaning operation, for example one wash, so the user does not have to dose the product. The water-soluble pouch around the product also serves to limit or avoid direct contact with the product by the user, which makes this execution more desirable than a tablet unit dose form.

Typically, the pouched composition has at least two compartments with product, whereof only one or more is opened by the user to pre-treat the material and one or more remain closed until the pouched composition is dissolved in water. The user can hold the closed compartment(s) and rub the other compartment(s) over the (stains on the) material (optionally first wetted), to dispense the product in that opened compartment. The rubbing action may cause the compartment to open, or preferably the user opens the compartment before application onto the material. This is preferably done by a cutting or piercing device, such as a needle-shaped object.

Preferred is thus that the pouched compositions are packed in a container or box which contains such a cutting or piercing device, to facilitate easy opening of the compartment by the user.

SUMMARY OF THE INVENTION

The present invention relates to a method for treating material with a treatment composition which is comprised in a water-soluble pouch, involving the steps of:

a) opening at least a part of the pouch and dispensing part of the treatment composition onto the material;

b) adding the material of step a) and the remaining of the pouched treatment composition to an aqueous bath, thereby dispensing the remaining of the pouched treatment composition.

Preferred methods involve treating a material which is a hard-surface, including dish-ware, or more preferably which is a fabric (garment); then in the latter case, preferred is that the aqueous bath is a laundry washing machine.

Preferred is that the part of the treatment composition dispensed in step a) is in liquid form.

The pouch may be opened in step a) by applying pressure such that the pouch opens (bursts). It may also be preferred that the material in step a) is wet and by applying the pouched treatment composition onto the material in step a), the water-soluble pouch material opens because it dissolves in the area in contact with the wet material, thus allowing release of part of the composition in step a).

Preferred is that the pouch is partially opened by cutting, or even more preferred, piercing the pouch and form a hole. Thereby, the composition can flow from the pouch through the narrow hole onto the material in a controlled manner, typically controlled by application of pressure by the user onto the pouch (for example by pressing the pouched composition onto the material, or rubbing it over the material or squeezing the pouched composition). Typically, the pouch has more than one compartment and at least one, but not all compartments are opened in step a).

The invention also relates to specific pouched unit-dose treatment composition, which are shaped to be easy to hold in step a) above and/or which have an area of weakness in the pouch or a part of the pouch is removable, to allow the flow of liquid composition form the pouch in step a). The area of weakness may be achieved by providing a pouch having a compartment made of a film which is stretched and under tension, having thus an weak area where the film is most stretched.

A preferred pouched treatment composition herein, preferably a laundry detergent, has at least a first compartment comprising a liquid composition, preferably a thixotropic liquid. Preferred is also that the pouch has a second compartment, whereby the top wall of the second compartment is the bottom wall of the first compartment and the second compartment has side wall or side walls connected to the top wall with an internal angle of 60° to 120°, preferably from 80° to 100°. This allows the user to hold this latter, firm compartment while opening the first compartment and it allows a good hold when applying the liquid composition on the material (e.g. stained fabric).

Preferred is that the liquid composition in the first pouch, to be opened in step a), is thixotropic and contains a solvent and at least 20% by weight of said liquid composition of surfactant, preferably including nonionic surfactant, the liquid preferably having a pH of 3 to 7.5.

The pouched unit-dose treatment composition herein preferably has at least two compartments whereby the first compartment has a different size, shape and/or colour than the second compartment.

The invention also provides specific pouched treatment compositions whereby the pouch is made of a stretched film, preferably being a thermo-formed or more preferably a vacuum-formed pouch.

The invention also relates to a combination of a treatment composition in a water-soluble pouch as described herein and a cutting or piercing device, the water-soluble pouch, respectively, to be cut or pierced by the cutting or piercing device, preferably, the piercing device having a pin-shaped (or needle-shaped) part.

The invention also relates to a container comprising one or more pouched treatment compositions as described herein and a cutting or piercing device. The piercing device can be attached to the container or be present in the container as a separate item.

DETAILED DESCRIPTION OF THE INVENTION

Method of Treating Materials

The method of the invention involves at least two steps using a pouched treatment composition, namely first step a) opening at least a part of the pouch and dispensing part of the treatment composition onto the material; and then step b) adding the material of step a) and the remaining of the pouched treatment composition to an aqueous bath, thereby dispensing the remaining of the pouched treatment composition.

When used herein, the remaining of the pouched treatment composition is what remains of the pouched treatment composition after step a), thus typically at least part of the pouch and at least part of the composition.

Typically, the first step is done without addition of water during that step, in contrast with the second step which involves adding the remaining pouch and material an aqueous bath. It may be useful that the material treated in the method of the invention is wetted prior to step a), so that in step a) part of the pouch dissolves upon contact with the wet material and thus releases part of the composition.

The aqueous bath can be any container suitable to hold water and suitable to clean with or in, or for example a automatic washing machine. Preferred is thus that the first step is a pre-treatment step done by hand and the second step is the main wash in a washing machine.

The dispensing in step b) preferably involves reaction of the remaining pouch upon contact with water, preferably dissolution of the pouch, and subsequently dispersion and/or dissolution of the remaining composition.

Preferably, the pouch is only partially opened to control dispensing of treatment composition in step a), for example to avoid too much treatment composition leaving the pouch in step a) or to avoid the treatment composition dispensing too quickly. The pouch may be opened by any method, including by partial dissolution (as mentioned above), applying pressure onto the pouch to rupture the pouch.

Preferred is that the pouch has an area of weakness or an area which is removable. The are of weakness is an area on the pouch which resist pressure of force less than the remaining of the pouch. Preferred may be that the area of weakness is achieved by making an area of the pouch of chemically or physically different material than the rest, preferably a thinner material. Preferably may be that the pouch is of stretched film whereby the area most stretched is typicality thinner and forms an area of weakness. Preferred may also be that the pouch has an area of weakness which is an area surrounded by lines of weakness (perforations for example). The area of weakness may also be a removable area, for example a tear strip, flap.

The pouch may also be opened by removing part of the pouch; more preferred is that the pouch is opened by making a small opening in the pouch, typically by cutting piercing the pouch to form a hole. For example, the piercing can be done by a needle- or pin-shaped device, thus resulting in a small (pin) hole. It may be preferred that this is done in an area of weakness, for example a thinner part of the pouch, for example obtainable by stretching the material (preferably a film)used for making the pouch. Of course, it may be preferred that the pouch has an area of weakness which is to be cut or pierced to be opened.

Part of the treatment composition leaves the pouch through the opening, onto the material. Typically, this involved bringing the pouch with the opening in close proximity to the material, or typically stains on the material and dispensing some of the treatment composition throughout the opening. Preferred is that the pouched treatment composition is contacted with the material and the product is rubbed onto the material by rubbing the pouched treatment composition over the material.

The composition in step a may be solid or liquid. Preferably the composition dispensed in step a) is liquid, to allow a good flow through the opening onto the material. Preferably having a viscosity of the liquid is such that the liquid only leaves the pouch when a force is applied, for example the force applied by the user when rubbing the pouch onto the material, or for example by squeezing the opened pouch. Preferred are thus thixotropic liquid compositions. Preferred thixotropic compositions comprise structuring agents such as clays, preferably organically modified (hectorite) clay. Preferred may also be that the thixotropic liquid composition comprises surfactants and water, the surfactants gelling upon contact with said water.

Preferred is that the liquid has a viscosity (at 25° C.) of at least 200 Pa.s or even at least 50 Pa.s or even at least 100 Pa.s or even at least 150 Pa.s, or even at least 200 Pa.s, as measured at a shear rate of 1.7 $s^{-1}$.

The pouch herein is a closed structure, typically made of materials described herein, having an interior (a volume space) comprising therein a liquid and/or solid composition. The exact execution will depend on, for example, the type and amount of the composition in the pouch, the number of compartments in the pouch and the characteristics required from the pouched composition to hold, protect and deliver or release the compositions and to be held and used in the method of the invention.

Preferred is that the pouched compositions are unit-dose compositions, e.g. that a multitude of pouches, but preferably two pouches or more preferably one pouch, thus holds sufficient composition for a single treatment operation.

Preferred treatment compositions are personal care compositions, personal cleaning compositions, hard-surface cleaning compositions, dish-washing detergent compositions, laundry detergent compositions, laundry and dish washing additive compositions such as fabric enhancers, bleach compositions. Most preferred are hard-surface cleaners, laundry detergents and dish washing detergents, most preferably laundry detergents.

Preferred is that the pouch has at least two compartments, preferably attached to one another. The pouch preferably contains different compartments. Preferably, the different compartments comprise different compositions and/or preferably the compartments are visibly distinct, for example the compartments (or compositions) having a different colour, shape and/or size, or comprising compositions with visibly different properties, for example physical states (liquid and solid), different density, viscosity, colour, or mixtures thereof.

Preferred may be that one compartment in the pouch (opened in step a) is smaller than the second compartment.

Exact sizes will depend on how much each pouch need to contain and thus how much volume is required. For example, the first compartment (to be opened in step a)) has a volume or comprises an amount of product (by weight) which is less than 75% or even less than 60% of the volume of the second pouch or the amount (by weight) in the second compartment, and typically more than 10%, preferably more than 15%.

Preferred is that the pouch has two or more compartments which are visually distinct, so the user knows which compartment(s) to open in the first step.

Preferred may be that one compartment comprises a solid composition and another compartment a liquid composition. It may be preferred that one compartment comprises a composition of a different viscosity, density, than the composition in the other compartment. Preferred may also be that the compositions or compartments or part thereof have different shades or colour, for example white and blue, or comprising speckle particles. Preferred may also be that one composition is a clear liquid and another an opaque liquid. It may also be preferred that one compartment is smaller than another compartment, typically such that the compartment to be opened in the first step is smaller than the other compartment.

Preferred is that the pouch is of such a shape that it is easy to hold by the user, allowing a hold even when some of the treatment composition is already dispensed in step a). Preferred is that the pouch comprises more than one compartment and that one or more compartments are opened in step a), but not all compartments. This allows the user to hold the pouch by the compartment which is not to be opened, whilst opening one or more of the other compartments and dispensing part of the treatment composition thereof.

Preferred is that one of the compartments, not to be opened has a firm or even rigid structure. Hereto, this compartment is preferably made by vacuum-forming or thermoforming, hereby stretching the pouch material to form a compartment under tension, as described herein after. Preferred is also that the compartment (which is not to be opened) comprises a solid composition, to further improve the grip by the user.

Also preferred is that the pouch has at least one compartment which has walls with a height (distance from bottom to top, connected by said walls) of at least 1 cm, preferably at least 1.5 cm or even at least 2 cm, typically up to about 10 cm, or preferably up to 6 cm or even up to 5 cm, to allow a better grip for the user.

Typically, the width or diameter of the pouch or compartment thereof is between 2 cm and 12 cm, preferably 2.5 cm or even 3 cm to 10 cm or even to 8 cm or even to 6 cm.

It may be preferred that the width or diameter of the first pouch, to be opened in step a), is smaller than the width or diameter of the other compartment, not opened in step b. Preferably is how ever that, when the first compartment is on top of the other compartment, the surface area of the bottom of the first compartment is at least 40% or even at least 50% or even at least 60% of the surface area of the top of the other compartment. This further ensures that the user can apply enough pressure to get the composition out of the compartment, in step a) of the method of the invention.

Preferably, this compartment comprises a solid and is made of a film material which is under tension and/or stretched. Preferred is also that the internal angle of the walls with the top of this compartment (being (connected to) the bottom of the other compartment) is between 60° to 120°, preferably 80° to 100° or even preferably about 90° (thus, the slope the side or walls of the pouch being of an angle as specified). This allows a better grip for the user. Preferred may be that the wall of at least one compartment, to be held by the user, is straight, rather than curved.

Preferred may be that the all compartments (preferably two) are made by stretching the material the compartments, e.g. film, to obtain compartments of stretched material, under tension. Hereby, the tension not only gives a good grip to one of the compartments, but facilitates opening of the other compartment.

Preferred pouched treatment compositions have at least one compartment of a shape having straight walls (connecting top and bottom of the pouch) rather than curved walls, thus preferred shapes include hexagonal shape, square shape, rectangular shape or cylindrical shape to allow a good hold and dispensing of the composition under slight pressure by the user (e.g. rubbing, squeezing):

Preferred may be that the pouch herein comprises a skirt, typically around part or all of the pouch, typically an frill-shaped skirt extending from the pouch. Typically the pouch is made by filling an open pouch shape and closing the open pouch by sealing. Then, the skirt or frill may be the sealing area, extending from the pouch.

Preferred may be that the pouch has at least two compartments on top of another and separated by the material of the pouch/compartments and that this material extends from the pouch, to thus form the skirt of the pouch. It may be preferred that it extends such that the thus formed skirt surrounds the pouch.

This edge or frill helps to prevent the user of the pouch in the method of the invention from getting in contact with the treatment composition in step a), when it leaves the pouch and is rubbed unto the (stained) material, e.g. fabric.

The width of this frill or edge (i.e. distance from pouch to end of frill or edge) is preferably at least 0.2 mm, more preferably at least 0.3 mm or even 0.5 mm or it may be even 1.0 cm or more, typically up to 3 cm or even up to 2 cm r even up to 1.5 cm.

When the pouched composition is for use in a laundry washing or dish washing machine and may need to be dispensed to the water via a dispensing drawer, it may be preferred that the remaining pouched composition, or preferably the pouched composition itself, is of such a size that it can dispense into the wash water through the drawer. However, alternatively the pouch is added into the drum of the machine directly, so that the size of the pouched composition or remaining pouched composition is not determined by the size of dispensing drawers.

Piercing or Cutting Device

The cutting or piercing device can be any device suitable to cut or pierce the pouch, typically making a scission, cut or hole in the pouch. Preferred are piercing devices having a sharp part, preferably having a sharp edge or point, for example a pin-shaped part or a hook, or a chisel shaped part or knife-shaped part. Most preferred are piercing devices, making a hole in the pouch. The size of the sharp edge or point of the device can be adjusted, depending on the size of the opening (hole, cut) required.

The cutting or piercing device may be attached to the container for the (unit-dose) pouched treatment compositions (e.g. box), or it may be a separate device.

Preferably the cutting or piercing device also has a also part suitable to be held by the user in the method of the invention. Preferred may be that the piercing or cutting device thus comprises a sharp part and a holder.

Preferred may be that the cutting or piercing device, typically the holder thereof, has a surface or volume capable to receive to pouched composition, typically such that the pouched composition to be opened by cutting or pierced matches the shape of the surface. For example it may be preferred that the pouched composition, or at least the part to be opened by cutting or piercing, has a round shape and that the cutting or piercing device has a hollow surface, wherein the pouch fits.

Container for Pouched Compositions

The pouched compositions are typically packed in a container. Typically, the container contains a number of pouched treatment compositions. Any container suitable for holding and storage of the pouched composition can be used.

Preferred are rigid containers, for example a box, having at least one wall, bottom or top which can be opened and closed. Typically, this is the top or lid of the container.

Preferred may be that the cutting or piercing device is attached to the container, for example to the opening top or lid. Preferred may be that the cutting or piercing device is at the outside of the box, to avoid contact with the pouched compositions during storage. It may also be preferred that the cutting or piercing device is in the box, preferably such that contact with the pouched compositions can be avoided. For example, the cutting or piercing device may be attached so that it can be moved in a position that is can be used to pierce the pouch and that it can be moved back in a position that it can not be used for piercing. For example the cutting or piercing device may be attached flat to a wall, top or bottom of the container and be moved to extend from that wall, top or bottom.

Pouch and Pouch Material

At least the remaining pouch herein is made from a water-reactive material, to provide a water-soluble pouched treatment composition. Preferably the pouch as a whole is made of water-reactive material.

For the purpose of the invention, water-reactive material means material which either dissolves, disperses or disintegrates (or mixtures thereof) upon contact with water, releasing thereby the composition. Preferably, the material is water-soluble.

The remaining pouch will react in water to release its content. To achieve sequential release in the second step b), the remaining pouch may comprise different compartments whereof one may be more water-soluble than another. This can for example be achieved by using different type of material for one compartment than another, for example, material having a different type of polymer, different plasticiser, different levels components in the material, different coating of the film material, different thickness of the film material.

The water-soluble film for the pouch preferably has a solubility in water of at least 50%, preferably at least 75% or even at least 95%, as measured by the method set out hereinafter using a glass-filter with a maximum pore size of 50 microns, namely:

Gravimetric method for determining water-solubility of the material of the compartment and/or pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility can be calculated.

Preferred materials for the pouch are films of polymeric materials, e.g. polymers which are formed into a film or sheet. The film can for example be obtained by casting, blow-moulding, extrusion or blow extrusion of the polymer material, as known in the art. Preferred polymers, copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). Most preferred is PVA film; preferably, the level of polymer in the film, for example a PVA polymer, is at least 60%.

The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartments or pouch, depending on the application thereof and the required needs. For example, it may be preferred that a mixture of polymers is present in the film, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-soluble.

It may be preferred that the polymer present in the film is from 60% to 98% hydrolysed, preferably 80% to 90%, to improve the dissolution of the material, and/or that the levels of plasticiser, including water, in the film are varied such that the dissolution is adjusted as required.

Most preferred are films which comprise a PVA polymer with similar properties to the film which comprises a PVA polymer and is known under the trade reference M8630 or CXP4087, as sold by Chris-Craft Industrial Products of Gary, Ind., US. Preferred may be that the first pouch is made of a film material having the properties of PVA polymer-containing film M8630 and that the second pouch is made of material having similar properties as PVA-containing film CXP4087. Preferred are the materials M8630 and/or CXP4087 itself.

The film herein may comprise other additive ingredients than the polymer or polymer material. For example, it may be beneficial to add plasticisers, for example water glycerol, ethylene glycol, diethyleneglycol, propylene glycol, sorbitol and mixtures thereof, and other additives, for example stabilisers, disintegrating aids. It may be useful that the pouch material itself comprises a treatment composition ingredients, for example a cleaning ingredient, to be delivered to the wash water, for example organic polymeric soil release agents, dispersants, dye transfer inhibitors, surfactants.

Preferably, the pouch is made of a material which is stretchable, as set out herein. This for example facilitates the closure of the open pouch, when is filled for more than 90% or even 95% by volume or even 100% or even over filled. Moreover, the material is preferably elastic, to for example to ensure a firmly formed pouch, preferably rigid pouch, easy to pierce and to hold by the user, and to ensure tight packing and fixation of the composition therein during handling and use.

Preferred stretchable materials have a maximum stretching degree of at least 150%, preferably at least 200%, more preferably of at least 400% as determined by comparison of the original length of a piece of material with the length of this piece of material just prior to rupture due to stretching, when a force of at least 1 Newton is applied to a piece of film with a width of 1 cm. Preferably, the material is such that it has a stretching degree as before, when a force of at least 2 Newton, or even at least 3 Newton is used. Preferably, it has this stretching degree when a force of the above lower limits is used, but not more than 20 Newton, or even 12 Newton, or even 8 Newton. For example, a piece of film with a length of 10 cm and a width of 1 cm and a thickness of 40 microns is stretched lengthways with an increasing stress, up to the point that it ruptures. The extent of elongation just before rupture can be determined by continuously measuring the length and the degree of stretching can be calculated. For example, this piece of film with an original length of 10 cm can be stretched with a force of 9.2 Newton to 52 cm just before breaking, and then is has a maximum stretching degree of 520%.

The force to stretch such a piece of film (10 cm×1 cm×40 microns) to a degree of 200% should preferably be at least 1 Newton, preferably at least 2 Newton, more preferably at least 2.5 or even 3 Newton, and preferably no more than 20 Newton, preferably less than 12 Newton, most preferably less than 8 Newton. This in particular ensures that the elastic force remaining in the film after forming the pouch or closing the pouch is high enough to pack the composition tightly within the pouch (but not so high that the film cannot be drawn into a vacuum mould of reasonable depth, when the pouch is made by a process involving the use of vacuum, such as by vacuum-forming or thermo-forming).

As is clear form the definition herein, the stretchable material is defined by a degree of stretching measured when it is not present as a closed pouch. However, as said above, the material is preferably stretched when forming or closing the pouch. This can for example been seen by printing a grid onto the material, e.g. film, prior to stretching, then forming a pouch; it can be seen that squares of the grid are elongated and thus stretched.

The elasticity of the stretchable material of the can be defined as the 'elasticity recovery'. This can be determined by stretching the material for example to an elongation of 200%, as set out above, and measuring the length of the material after release of the stretching force. For example a piece of film of a length of 10 cm and width 1 cm and thickness of 40 microns is stretched lengthways to 20 cm (200% elongation) with a force of 2.8 Newtons (as above), and then the force is removed. The film snaps back to a length of 12 cm, which means 80% elastic recovery.

Preferably, the pouch material has an elasticity such that the elastic recovery is from 20% to 100%, more preferably 50% or even from 60% or even from 75% or even 80% to 100%.

Typically and preferably, the degree of stretching in non-uniform over the pouch, due to the formation and closing process. For example, when a film is positioned in a mould and an open pouch is formed by vacuum forming, the part of the film in the bottom of the mould, furthest removed form the points of closing, will be stretched more than in the top part. Another advantage of using stretchable and preferably also elastic material, is that the stretching action stretches the material non-uniformly, which results in a pouch which has a non-uniform thickness. This allows control of the dissolution/disintegration or dispersion of the pouches herein. Preferably, the material is stretched such that the thickness variation in the pouch formed of the stretched material is from 10 to 1000%, preferably 20% to 600%, or even 40% to 500% or even 60% to 400%. This can be measured by any method, for example by use of an appropriate micrometer.

Process for Making the Pouched Treatment Compositions

The pouch can be made and filled by any process. When more than compartment is present in the pouch, it may be preferred that each compartments is first formed and then sealed together. However, to reduce pouch material, it is more preferred that one compartment is first made and used as part of the other compartment, typically, one open compartment being closed by a pre-formed, closed (sealed) compartment.

The pouch herein is preferably made by thermo-forming or even more preferred by vacuum-forming. Because vacuum-formed pouches, and thermo-formed pouches to a lesser extend, have a number of advantages, as described above, it is preferred to use such a process for the formation of the pouches herein. Thermo-forming typically involves the step of formation of an open pouch in a mould under application of heat, which allows the material used for the pouch to take on the shape of the mould. Vacuum-forming typically involves the step of applying a (partial) vacuum (reduced pressure) on a mould which sucks the material into the mould and ensures the material adopts the shape of the mould. The pouch forming (or compartment forming) process may also be done by first heating the material and then applying reduced pressure, e,g. (partial) vacuum.

For example, an open compartment is formed in a mould and then filled with the required composition then closed, typically with another piece of material or with another compartment, and sealed.

The sealing can be done by any known method, for example by heat sealing, wetting, use of gluing agent, compression, or combinations thereof.

The seal can extend from the pouch, forming a skirt around the pouch, as described herein before, and thereto it may be cut into the right width. Alternatively, it may be preferred that the seal does not extend from the pouch and then it may be cut-off completely.

Treatment Compositions

Preferred treatment compositions are compositions with a dual purpose, for example pre-treatment and cleaning, cleaning and fabric enhancing or softening, cleaning and dyeing. Preferred treatment compositions herein are useful in cleaning operations, such as hand and automatic laundry and dish washing, hard-surface cleaning, personal cleaning, and specialised fabric treatment compositions such as bleach additives, dye compositions, and fabric care or enhancing compositions, such as fabric conditioners.

Preferably, the treatment composition is a cleaning composition and comprises at least a surfactant. Preferably, it comprises also builders, bleach, enzymes, chelating agents and/or perfumes.

Highly preferred is that the treatment compositions is divided over different compartment and that the compositions differ chemically per compartment.

Preferred is that the composition dispensed in step a) contains stain treatment ingredients, preferably comprising at least a surfactants, preferably at least a anionic and/or nonionic surfactant, preferably also a chelanting agent and/or enzymes and/or soil (clay) dispersing agents, such as cationic alkoxylated amines, and/or perfume. The composition dispensed in step a) may comprise bleaching agents, but it is preferred that this is free of bleaching agents, to avoid contact of bleach in undiluted form with the stained material in step a).

The composition to be dispensed in step a) preferably comprise at least builders, additional surfactant, bleaching agents, perfume, fabric softener or conditioner, or mixtures thereof.

Highly preferred in the fabric treatment composition herein are fabric integrity polymers as described herein after. Also highly preferred are fabric softening agents as described herein.

It may be preferred that the composition dispensed in step a) has a pH of 3.0 or even 3.5 to 7.5 or even 7.0 or even 6.5 or even 6.0. It may be preferred that the composition dispensed in step a) comprises acidic agents, to reduce the pH of the composition.

It may be preferred that the composition dispensed in step a) comprises an organic carboxylic acid, such as citric acid, fumaric acid, maleic acid, or polymeric polycarboxylic acid. Highly preferred is citric acid. Preferred levels are from 1% to 20% or even 2% to 15% or even 3% to 12% by weight of the total treatment composition.

Preferred may also be that a carbonate source is present, such as a salt of carbonate or bicarbonate, which can react upon contact with water, with the acid, t provide effervescing and improved dissolution of the pouched treatment composition.

It may be preferred that the composition not dispensed in step a) has a pH which is higher than the pH of the composition dispensed in step a), for example from 7.5 or even 8 or even 9 or even 9.5 to 12 or even to 11 or even to 10.5.

It may be preferred that the first composition is liquid, including non-aqueous liquids and gels, which is transparent. It may also be preferred that the compositions have a different physical state, for example that the first composition is liquid and the second composition is solid. Then, it may be preferred that the first compartment comprises a composition containing liquid surfactants and solvent, preferably including at least nonionic surfactant and organic solvent, and preferably perfume oils, water and other solvents; then, it may also be preferred that the other composition, not dispensed in step a) but only in step b), comprises solid ingredients, for example actives which are not very soluble in organic solvent or water, or even insoluble, or which are more efficiently or effectively delivered, incorporated or performing in solid form: for example enzyme granules, bleach granules, insoluble builders and polymeric ingredients, salts of builders or surfactants, perfume granules, clay, effervescence sources.

Also preferred may be that the division of ingredients per composition is done based on their chemical or physical compatibility, for example that the composition; for example, one compartment may comprise a composition with bleach and the other compartment a composition with a bleach sensitive or reactive ingredient such as perfumes, enzymes, organic polymers, bleach catalysts.

As described above, preferred are effervescence sources, capable of producing a gas upon contact with water, typically $CO_2$ gas, formed by reaction of a carbonate source and an acid source, preferably a carbonate salt and an organic carboxylic acid, such a citric acid, malic acid, maleic acid, glutaric acid, fumaric acid. Also preferred are other dissolution or dispensing aids, as known in the art.

If a liquid composition is present, it preferably comprises one or more solvent, preferably from 1% to 60% or even 5% to 50% or even 8% to 40% by weight of the liquid composition. Preferred are organic solvents such as methyl or ethyl or methoxylated or ethoxylated amines, alcohols, polyethylene glycol, glycerol, water and mixtures thereof. Preferred may be that only small amounts of water, up to 20% or even up to 10% or up to 8% or even up to 4% by weight of the liquid composition. Preferably, other solvents are present, such as alcohols, glycerine, polyethylene glycol, paraffin.

Preferred Ingredients of Treatment Compositions

The preferred surfactants for the compositions herein are selected from anionic, nonionic, cationic, ampholytic, amphoteric and zwitterionic surfactants and mixtures thereof. Preferably the compositions comprise from 5% more preferably from 10%, yet more preferably from 15%, to 80%, more preferably to 50%, yet more preferably to 30% by weight of the composition of surfactant.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 16 carbon atoms.

Highly preferred, in particular such that it is dispensed in step a) at least, are alkoxylated, preferably ethoxylated, cationic monoamines, diamines polyamines. The positive charge of the N+ groups is offset by the appropriate number of counter anions. Suitable counter anions include Cl—, Br—, $SO_3$—$^{2}$, $PO_4$—$^{2}$, $MeOSO_3$— and the like.

Particularly preferred counter anions are Cl— and Br—.

Preferred are cationic amines substituted with one or more polyoxyalkylene moieties—$[(R^6O)_m(CH_2CH_2—O_n)—]$. The moieties —$(R^6O)$m— and —$(CH_2CH_2O)$n— of the polyoxyalkylene moiety can be mixed together or preferably form blocks of —$(R^6O)_m$— and —$(CH_2CH_2O)_n$— moieties. $R^6$ is preferably $C_3H_6$ (propylene); m is preferably from 0 to about 5 and is most preferably 0, i.e. the polyoxyalkylene moiety consists entirely of the moiety —$(CH_2CH_2O)_n$—. The moiety —$(CH_2CH_2O)_n$— preferably comprises at least about 85% by weight of the polyoxyalkylene moiety and most preferably 100% by weight (m is O).

Preferred ethoxylated cationic monoamines and diamines have the formula:

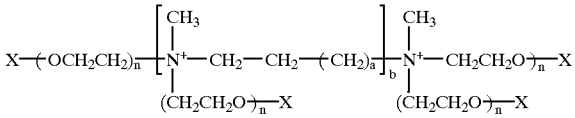

wherein X and n are defined as before, a is from 0 to 20, preferably from 0 to 4 (e.g. ethylene, propylene, hexamethylene), b is 1 or 0. For preferred cationic monoamines (b=0), n is preferably at least about 14, with a typical range of from about 16 to about 35, or even 17 to 25. For preferred cationic diamines (b=1), n is at least about 12 with a typical range of from about 12 to about 42.

The composition herein preferably comprises a bleaching agent, or even a mixture of bleaching agents. Preferably the treatment compositions comprise from 3% more preferably from 5%, yet more preferably from 10%, to 40%, more preferably to 25%, yet more preferably to 20% by weight of the composition of bleaching agent.

Suitable N-acylated lactam perbenzoic acid precursors have the formula:

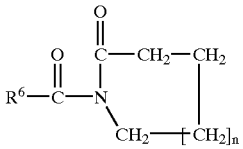

wherein n is from 0 to 8, preferably from 0 to 2, and $R^6$ is a benzoyl group.

A preferred class of substituted perbenzoic acid precursor compounds are the amide substituted compounds of the following general formulae:

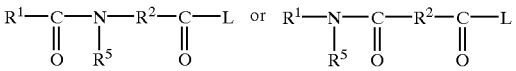

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

The hydrophobic peroxy acid bleach precursor preferably comprises a compound having a oxy-benzene sulphonate group, preferably nonanoyl oxy-benzene sulphonate (NOBS), decanoyl oxy-benzene sulphonate (DOBS) and/or comprising (6-nonamidocaproyl)oxybenzene sulfonate (NACA-OBS).

Also highly preferred are more hydrophilic peroxy acid bleach precursors or activators such as TAED.

Also preferred bleaching agent for use herein are particulate peracids. In an even more preferred embodiment the peracid is selected from the range of pre-formed mono peroxycarboxylic acid. In an even more preferred embodiment the pre-formed peracid is phthaloyl amido peroxyhexanoic acid, known as PAP.

The bleach activator or precursor and/or the pre-formed peracid is preferably used in particulate form, or as a particle, suspended in a liquid matrix. The liquid matrix where present is substantially non-aqueous meaning that it does not comprise a level of water that would result in the dissolution of the bleach precursor or peracid. Preferred suspending agent used to suspend the bleach activator or precursor, or the peracid are solvents which do not either dissolve or damage the pouches. More preferably the suspending agent is a long chain, low polarity solvent. By long chain it is meant solvents comprising a carbon chain of greater than 6 carbon atoms and by low polarity it is meant a solvent having a dielectric constant of less than 40. Preferred solvents include C12–14 paraffin and more preferably C12–14 isoparaffin.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate (a perhydrate salt in the form of the monohydrate of nominal formula $NaBO_2H_2O_2$ or the tetrahydrate $NaBO_2H_2O_2.3H_2O$), may be used, but is not compatible with certain pouch materials with —OH groups, such as PVA, and is thus often not preferred.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Chloride bleaches may also be useful, in particle when the article is a bleach additive or hard surface cleaner. Suitable bleaches are hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent is sodium hypochlorite, potassium hypochlorite, or a mixture thereof. A preferred chlorine-based bleach can be Triclosan (trade name).

A preferred ingredients of the liquid compositions herein are opacifying agents and or dyes, to dye the liquid composition, and dyed particles or speckles for solid compositions herein. The dye as used herein can be a dye stuff or an aqueous or nonaqueous solution of a dye stuff. It may be preferred that the dye is an aqueous solution comprising a dyestuff at any level, to add to liquid compositions or to obtain dyed particles by applying the solution onto granules, preferably such that levels of dye are obtained up to 5%, or even up to 2% by weight of a composition. The dye may also be mixed with a non-aqueous carrier material or organic binder materials, which may also be a non-aqueous liquid.

The dyestuff can be any suitable dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

Also useful herein are fabric substantive dyes (in contrast to the above dyes which are not fabric substantive), to provide dyeing of fabrics treated with the article of the invention.

Another preferred ingredient of the compositions herein is a perfume oil or perfume composition. Any perfume oil or composition can be used herein. The perfumes may also be encapsulated. Preferred may be that the second pouch comprises the perfume, so that this is delivered at a later stage, to ensure a more efficient delivery of the perfume to the fabric.

Preferred perfumes containing at least one component with a low molecular weight volatile component, e.g. having a molecular weight of from 150 to 450 or preferably 350. Preferably, the perfume component comprises an oxygen-containing functional group. Preferred functional groups are aldehyde, ketone, alcohol or ether functional groups or mixtures thereof.

Preferred aldehydes are selected from citral, 1-decanal, benzaldehyde, florhydral, 2,4-dimethyl-3-cyclohexen-1-carboxaldehyde; cis/trans-3,7-dimethyl-2,6-octadien-1-al; heliotropin; 2,4,6-trimethyl-3-cyclohexene-1-carboxaldehyde; 2,6-nonadienal; alpha-n-amyl cinnamic aldehyde, alpha-n-hexyl cinnamic aldehyde, P. T. Bucinal, lyral, cymal, methyl nonyl acetaldehyde, trans-2-nonenal, lilial, trans-2-nonenal, lauric aldehyde, undecylenic aldehyde, mefloral and mixture thereof.

Preferably, the perfume ketone is selected from buccoxime; iso jasmone; methyl beta naphthyl ketone; musk indanone; tonalid/musk plus; Alpha-Damascone, Beta-Damascone, Delta-Damascone, Iso-Damascone, Damascenone, Damarose, Methyl-Dihydrojasmonate, Menthone, Carvone, Camphor, Fenchone, Alpha-Ionone, Beta-Ionone, Gamma-Methyl so-called Ionone, Fleuramone, Dihydrojasmone, Cis-Jasmone, Iso-E-Super, Methyl-Cedrenyl-ketone or Methyl-Cedrylone, Acetophenone, Methyl-Acetophenone, Para-Methoxy-Acetophenone, Methyl-Beta-Naphtyl-Ketone, Benzyl-Acetone, Benzophenone, Para-Hydroxy-Phenyl-Butanone, Celery Ketone or Livescone, 6-Isopropyldecahydro-2-naphtone, Dimethyl-Octenone, Freskomenthe, 4-(1-Ethoxyvinyl)-3,3,5,5, -tetramethyl-Cyclohexanone, Methyl-Heptenone, 2-(2-(4-Methyl-3-cyclohexen-1-yl)propyl)-cyclopentanone, 1-(p-Menthen-6(2)-yl)-1-propanone, 4-(4-Hydroxy-3-methoxyphenyl)-2-butanone, 2-Acetyl-3,3-Dimethyl-Norbornane, 6,7-Dihydro-1,1,2,3,3-Pentamethyl-4(5H)-Indanone, 4-Damascol, Dulcinyl or Cassione, Gelsone, Hexalon, Isocyclemone E, Methyl Cyclocitrone, Methyl-Lavender-Ketone, Orivon, Para-tertiary-Butyl-Cyclohexanone, Verdone, Delphone, Muscone, Neobutenone, Plicatone, Veloutone, 2,4,4,7-Tetramethyl-oct-6-en-3-one, Tetrameran, hedione, and mixtures thereof.

More preferably, for the above mentioned compounds, the preferred ketones are selected from Alpha Damascone, Delta Damascone, Iso Damascone, Carvone, Gamma-Methyl-Ionone, Iso-E-Super, 2,4,4,7-Tetramethyl-oct-6-en-3-one, Benzyl Acetone, Beta Damascone, Damascenone, methyl dihydrojasmonate, methyl cedrylone, hedione, and mixtures thereof.

Preferred are also perfume compositions comprising perfume oils and a carrier material, for example as described in JP-56075159, describing the combination of methacrylonitrilebutadiene-styrene tertiary polymer with a liquid perfume; GB2141726, DE 3247709; WO 97/34982; WO 94/19449; WO 98/28398. Preferably, the carrier is a water-insoluble polymer, preferably selected from polymers which have chemically reacted with the perfume ingredient, to make the carrier as above mentioned.

Preferably the treatment compositions comprise from 0.05% more preferably from 1%, yet more preferably from 3%, to 15%, more preferably to 10% by weight of the composition of perfume oil or perfume composition.

The compositions herein preferably contain a heavy metal ion sequestrant or chelant or chelating agent. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly(alkylene phosphonates), alkali metal ethane 1-hydroxy disphosphonates and nitrilo trimethylene phosphonates.

Preferred among the above species are diethylene triamine penta (methylene phosphonate), ethylene diamine tri(methylene phosphonate)hexamethylene diamine tetra (methylene phosphonate) and hydroxy-ethylene 1,1diphosphonate, 1,1hydroxyethane diphosphonic acid and 1,1hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N—N'-diglutaric acid (EDDG) and 2-hydroxypropylenediamine-N—N'-disuccinic acid (HPDDS) are also suitable.

Especially preferred are diethylenetriamine pentacetic acid, ethylenediamine-N,N'-disuccinic acid (EDDS) and 1,1hydroxyethane diphosphonic acid or the alkali metal, alkaline earth metal, ammonium, or substituted ammonium salts thereof, or mixtures thereof.

In particular the chelating agents comprising a amino or amine group can be bleach-sensitive and are suitable in the compositions of the invention.

Another highly preferred ingredient useful in the compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/U.S. Pat. No. 9,703,635, and in WO95/26397 and WO96/23873.

Amylase enzyme may be incorporated into the composition in accordance with the invention at a level of from 0.0001% to 2% active enzyme by weight.

Lipolytic enzyme may be present at levels of active lipolytic enzyme of from 0.0001% to 2% by weight, preferably 0.001% to 1% by weight, most preferably from 0.001% to 0.5% by weight.

The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

The phosphate-containing builder material preferably comprises tetrasodium pyrophosphate or even more preferably anhydrous sodium tripolyphosphate.

Also preferred herein are builders, such as water-soluble and water-insoluble builders. Preferred water-insoluble builders, typically for solid compositions herein are alumino silicates such as zeolites (zeolite A, MAP, P, X) and layered silicates such as known as SKS-6, sold by Clariant.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Also preferred in treatment compositions hererin are fabric integrity polymers such as cyclic amine based polymers, including adducts of two or more compositions selected from the group consisting of piperazine, piperadine, epichlorohydrin, epichlorohydrin benzyl quat, epichlorohydrin methyl quat, morpholine and mixtures thereof.

Highly preferred cyclic amine based polymers herein are referred to as Imidazole-epi chlorohydrin copolymers. These cyclic amine based polymers can be linear or branched. One specific type of branching can be introduced using a polyfunctional crosslinking agent. An example of such polymer is exemplified below.

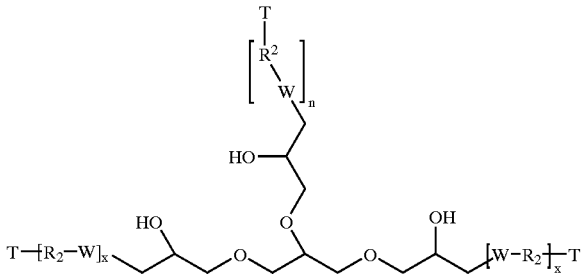

This material will generally be about 0.01% to about 10% by the weight of the detergent composition or component, more preferably from 0.05% to 6% or even from 0.05% to 3%.

The treatment compositions herein may also comprise as soil release or fabric integrity agents, salt of an anionic cellulose material comprising an anionic substituent group R—X—Z wherein R is a saturated, unsaturated or aromatic hydrocarbon spacer group, X is oxygen, nitrogen or sulphur, Z is carboxylate, sulphonate, sulphate or phosphonate group. The hydrocarbon spacer group is preferably a $C_1$–$C_{18}$, more preferably a $C_1$–$C_{14}$, or even more preferably a $C_1$–$C_4$ saturated, unsaturated or aromatic group, preferably an alkylene group. The spacer group may also be substituted with one or more hydroxy groups. The group X is preferably a nitrogen, or even more preferably an oxygen atom. The group Z is preferably a carboxylate group. Highly preferred hereon are the so-called salts of carboxyalkyl celluloses, whereby preferably the alkylene group (or the so-called alkyl group) comprises from 1 to 4 carbon atoms. Most preferred herein is a salt of carboxymethyl cellulose. The cation of the salt is preferably a potassium ion or more preferably a sodium ion.

Depending on the application of the composition, the amount of cellulose material may very. The anionic cellulose material will generally be about 0.01% to about 10% by the weight of the detergent composition or component, more preferably from 0.05% to 6% or even from 0.05% to 3% by weight of a composition.

The softening ingredients useful herein may be selected from any known ingredients that provides a fabric softening benefit.

Clay minerals used to provide the softening properties of the instant compositions can be described as expandable, three-layer clays, i.e., alumino-silicates and magnesium silicates, having an ion exchange capacity of at least 50 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite-type clays; in the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$ for the aluminum and magnesium oxide type clay, respectively. It is to be recognised that the range of the water of hydration in the above formulas can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while metal cations such as Na+, Ca++, as well as H+, can be co-present in the water of hydration to provide electrical neutrality. Except as noted hereinafter, such cation substitutions are immaterial to the use of the clays herein since the desirable physical properties of the clays are not substantially altered thereby.

However, smectites, such as montmorillonite and bentonite, having an ion exchange capacity of around 70 meq/100 g., and montmorillonite, which has an ion exchange capacity greater than 70 meq/100 g., have been found to be useful in the instant compositions in that they are deposited on the fabrics to provide the desired softening benefits. Accordingly, clay minerals useful herein can be characterised as expandable, three-layer smectite-type clays having an ion exchange capacity of at least about 50 meq/100 g.

The smectite clays used in the compositions herein are all commercially available. Such clays include, for example, montmorillonite, volchonskoite, nontronite, hectorite, saponite, sauconite, and vermiculite. The clays herein are available under various tradenames, for example, Thixogel #1® and Gelwhite GP® from Georgia Kaolin Co., Elizabeth, N.J.; Volclay BC® and Volclay #325®, from American Colloid Co., Skokie, Ill.; Black Hills Bentonite BH450®, from International Minerals and Chemicals; and Veegum Pro and Veegum F, from R. T. Vanderbilt. It is to be recognised that such smectite-type minerals obtained under the foregoing tradenames can comprise mixtures of the various discrete mineral entities. Such mixtures of the smectite minerals are suitable for use herein.

While any of the smectite-type clays having a cation exchange capacity of at least about 50 meq/100 g. are useful herein, certain clays are preferred. For example, Gelwhite GP® is an extremely white form of smectite clay and is therefore preferred when formulating white granular detergent compositions. Volclay BC®, which is a smectite-type clay mineral containing at least 3% of iron (expressed as $Fe_2O_3$) in the crystal lattice, and which has a very high ion exchange capacity, is one of the most efficient and effective clays for use in laundry compositions and is preferred from the standpoint of product performance.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the granular detergent compositions disclosed herein.

The clay is preferably mainly in the form of granules, with at least 50%, preferably at least 75%, and more preferable at least 90% being in the form of granules having a size of at least 0.1 mm up to 1.8 mm, preferably up to 1.18 mm, preferably from 0.15 mm to 0.85 mm. Preferably the amount of clay in the granules is at least 50%, more preferably at least 70% and most preferably at least 90% by weight of the granules.

Smectite clays are disclosed in the U.S. Pat. Nos. 3,862,058, 3,948,790, 3,954,632 and 4,062,647. European Patents No.s EP-A-299,575 and EP-A-313,146 in the name of the Procter and Gamble Company describe suitable organic polymeric clay flocculating agents.

Other suitable softening ingredients are long chained polymers and copolymers derived from such monomers as ethylene oxide, acrylamide, acrylic acid, dimethylamino ethyl methacrylate, vinyl alcohol, vinyl pyrrolidone and ethylene imide. Preferred are polymers of ethylene oxide, acrylamide and acrylic acid. These polymers preferably have average molecular weight in the range of from 100 000 to 10 million, more preferably from 150 000 to 5 million. Average molecular weight of a polymer can be easily measured using gel permeation chromatography, against standards of polyethylene oxide of narrow molecular weight distributions. The most preferred polymers are polyethylene oxides.

Other suitable softening ingredients include cationic fabric softening agents can also be incorporated into compositions in accordance with the present invention which are suitable for use in methods of laundry washing. Suitable cationic fabric softening agents include the water insoluble tertiary amines or dilong chain amide materials as disclosed in GB-A-1 514 276 and EP-B-0 011 340.

Other preferred ingredients are neutralizing agents, buffering agents, including (bi) carbonate salts, phase regulants, hydrotropes, enzyme stabilizing agents, polyacids, suds regulants, anti-oxidants, bactericides, or mixtures thereof.

EXAMPLES

Example I

A first pouch is made in a mould of a hollow shape. The mould has some holes in the mould material to allow a vacuum to be applied. A piece of (optionally heated) Chris-Craft M-8630 or CXP4087 film is placed on top of this mould. A vacuum is applied to pull the film into the mould and pull the film flush with the inner surface of the mould. Composition 1 2 or 3 below is poured into the mould, preferably in an amount to almost or completely fill the mould. Then, another piece of the same film material is placed over the mould and sealed to the first piece of film by applying heat.

A second larger pouch is formed in mould of a cylindrical shape, having a diameter just larger than the first pouch and a depth of 2.5 cm. The mould has some holes in the mould material to allow a vacuum to be applied. A piece of (optionally heated) Chris-Craft M-8630 film is placed over the top of this mould and a vacuum is applied to pull the film into the mould and pull the film flush with the inner surface of the mould. Composition 4, 5 or 6 below is added into the mould, preferably in an amount to completely fill the mould. Then the first pouch is placed over the mould and sealed to the first piece of film by applying heat (typically with a temperature of from 135° C. to 150° C. and applied for up to 5 seconds.)

This process can be modified by using other methods of forming the shape of the pouches, other types of film, other sizes of mould, sealing methods, more individual pouches etc.

The following is an example of a PVA pouch made by vacuum forming or thermo-forming as described herein, having two compartments, one compartment comprising liquid composition 1, 2 or 3 and one compartment comprising solid composition 4, 5 or 6. The weight ratio of the liquid composition to the solid composition may be varied, but is herein below typically about 1:3. The values are by weight of the specified composition.

| | 1 | 2 | 3 | 4 | 5 | 6 |
|---|---|---|---|---|---|---|
| LAS and/or alkyl sulphate surfactant | 25.0 | — | 40.0 | 10.0 | 13.5 | 5.0 |
| nonionic surfactant | 45.0 | 50.0 | | | 3.0 | |
| TAE 80 | | 5.0 | | 1.0 | | 1.0 |
| cationic surfactant | | 5.0 | 5.0 | 2.0 | | |
| Layered silicate | | | | | 5.0 | |
| Zeolite A/ phosphate | | | | 15.0 | 15.0 | 22.0 |
| Citric acid | | | | 10.0 | 6.0 | 7.0 |
| Sodium citrate | | | | 1.0 | 3.0 | — |
| Sodium bicarbonate | | | | | 10.0 | 9.0 |
| Sodium carbonate | | | | 10.0 | 10.0 | 14.0 |
| MEA | 5.0 | 10.0 | 9.0 | | | |
| Fatty acid | | | 10.0 | | | |
| Ethanol | 15.0 | 10.0 | 10.0 | | | |
| Plasticiser (PEG, glycerol) | 3.0 | | 5.0 | 1.0 | | 2.0 |
| Percarbonate | | | | 18.0 | 10.0 | 15.0 |
| Bleach activator | | | | 5.0 | 5.0 | 3.0 |
| QEA# | 5.0 | | 10.0 | 5.0 | | |
| Chelant (EDDS, HEDP, DTPA) | 5.0 | 11.0 | 6.0 | 3.0 | 3.0 | 3.0 |
| Imidazole-based polymer | | | | 2.0 | | 2.0 |
| Maleic/acrylic acid or salt copolymer | | | | 2.0 | 2.0 | 4.0 |
| Brightener | | | | 1.0 | 1.0 | 1.0 |
| Dye Transfer inhibiting polymer | | | | 2.0 | 2.0 | 2.0 |
| protease enzyme | | 2.0 | 3.0 | 1.0 | 2.0 | 1.0 |
| Amylase enzyme | | 2.0 | | 1.0 | 1.0 | 1.0 |
| Cellulase enzyme | | 2.0 | | 1.0 | 1.0 | |
| Cellulose-based polymer | | | | 2.0 | 3.0 | 2.5 |
| Perfume | | 2.0 | 0.5 | 2.0 | 2.0 | 2.0 |
| Dye | 2.0 | 1.0 | 0.5 | 0.5 | 0.5 | 0.5 |
| Suds suppressor | | | | 2.0 | 1.0 | 2.0 |
| Soap | | | 1.0 | 0.5 | | 0.5 |
| Minors up to total 100% | | | | | | |

#QEA: bis($(C_2H_5O)(C_2H_4O)_n$)($CH_3$)—$N^+$ $C_6H_{12}N^+$ ($CH_3$)bis($(C_2H_5O)(C_2H_4O)_n$),
wherein n is from 15 to 30, preferably 17 to 20.

What is claimed:

1. A method for treating material with a treatment composition which is comprised in a water-soluble pouch, involving the steps of:

a) opening at least a part of the pouch and dispensing part of the treatment composition onto the material;

b) adding the material of step a) and the remaining of the pouched treatment composition to an aqueous bath, thereby dispensing the remaining of the pouched treatment composition.

2. A method of claim 1 whereby the material is fabric and the aqueous bath is a washing machine.

3. A method as in claim 1 whereby the part of the treatment composition dispensed in step a) is liquid.

4. A method according to claim 3, wherein the liquid is a thixotropic liquid.

5. A method according to claim 1 whereby the in step a) the pouch is partially opened by means selected from cutting means, piercing means, or combinations thereof.

6. A method according to claim 1 whereby the pouch has at least two compartments, whereby in step a) at least one compartment, but not all compartments, is opened and whereby the compartment(s) opened in step a) comprises a liquid composition, whereby the compartment(s) not opened in step a) comprises a solid composition.

7. A method according to claim 1 whereby in step a) the part of the treatment composition is dispensed onto stains on the material and rubbed onto the stains.

8. A method according claim 1 whereby the pouch is made of a water-soluble film which is stretched.

9. A method according to claim 8 wherein the water soluble film is selected from the group consisting of polyvinyl alcohol films, derivatives of polyvinyl alcohol films, and mixtures thereof.

10. A method as in claim 3 whereby the pouched treatment composition is a unit-dose treatment composition, having at least a first compartment comprising a liquid composition to be opened is step a) and at least a second compartment which is not opened in step a), whereby the top wall of the second compartment is the bottom wall of the first compartment and the second compartment has side wall or side walls connected to the top with an internal angle of 60° to 120°, preferably 80° to 100°, or even preferably about 90°.

11. A method as in claim 10 whereby the pouched treatment composition is a laundry detergent and the second compartment has side wall or side walls connected to the top wall with an internal angle of about 90°.

12. A method as in claim 1 whereby the pouched treatment composition is a unit-dose treatment composition, and the treatment composition is divided over at least a first and a second compartment in the pouch, whereby the first compartment comprises a liquid composition to be opened in step a) and the first compartment is visibly different to the second compartment.

13. A method according to claim 12 wherein the first compartment is visibly different to the second compartment selected from the group consisting of having a different size, having a different shape, having a different color, and combinations thereof, than the second compartment.

14. A unit-dose pouched treatment composition, having at least a first compartment comprising a liquid composition and a second compartment comprising a solid composition, whereby the top wall of the second compartment is the bottom wall of the first compartment and the second compartment has side wall or side walls of a height of at least 1 cm wherein the side wall or side walls connect the top and bottom of said second compartment and the side wall or side walls are connected to the top wall with an internal angle of from 60°to 120°.

15. A unit-dose pouched treatment composition according to claim 14, whereby the liquid composition is thixotropic and contains a solvent and at least 20% by weight of said liquid composition, of surfactant.

16. A unit-dose pouched treatment composition according to claim 15 wherein the liquid composition has a pH of from 3 to 7.5.

17. A unit-dose pouched treatment composition as in claim 14, whereby the pouch comprises two compartments attached to one another, the first compartment having less than half the volume of the second compartment.

18. A unit-dose pouched treatment composition according to claim 14 having a skirt extending from at least one of the sides of the pouch.

* * * * *